United States Patent [19]

Shiramatsu et al.

[11] Patent Number: 4,994,813

[45] Date of Patent: Feb. 19, 1991

[54] ANTENNA SYSTEM

[75] Inventors: Kuniaki Shiramatsu; Ryuji Ishii; Takashi Katagi; Tetsuo Haruyama; Nobutake Orime, all of Kamakura, Japan

[73] Assignee: Mitsubishi Denki Kabushiki Denki, Tokyo, Japan

[21] Appl. No.: 421,427

[22] Filed: Oct. 13, 1989

[30] Foreign Application Priority Data

Oct. 13, 1988 [JP] Japan ..... 63-257791
Oct. 13, 1988 [JP] Japan ..... 63-257792

[51] Int. Cl.[5] ..... H01Q 3/00; H01Q 3/22

[52] U.S. Cl. ..... 342/360; 342/372; 343/703

[58] Field of Search ..... 342/360, 372; 343/703

[56] References Cited

FOREIGN PATENT DOCUMENTS 57-93267 6/1982 Japan .
0211567 9/1987 Japan ..... 343/703

OTHER PUBLICATIONS

Chiba et al., "An Improved Method for Measuring Amplitude and Phase of Each Radiating Element of a Phased Array Antenna", '82/5 vol. J65-B, No. 5, pp. 555-560.

*Primary Examiner*—Gregory C. Issing
*Attorney, Agent, or Firm*—Sughrue, Mion, Zinn, Macpeak & Seas

[57] ABSTRACT

A phased array antenna includes a plurality of first antenna elements and a plurality of phase shifters respectively connected to the first antenna elements. An amplitude and a phase of each of the antenna elements are determined by a method of opposing a pick-up antenna at a distance from the phased array antenna to measure a composite power of the phased array antenna while changing phases of the phase shifters for determining the ratio of the maximum power to the minimum power, and the phase value for the maximum power, from which the amplitude and phase are computed. A second antenna element is incorporated in the phased array antenna as a pick-up antenna to measure with mutual coupling an amplitude and a phase of each antenna element by the method and to determine differences in amplitude and phase between the opposed pick-up antenna and the second antenna element so that an amplitude and a phase subsequently measured with the second antenna element are corrected with the differences in amplitude and phase to determine an amplitude and a phase of each antenna element.

13 Claims, 6 Drawing Sheets

ANTENNA SYSTEM

BACKGROUND OF THE INVENTION

The present invention relates to an antenna device capable of measuring the amplitude and phase of each antenna element of a phased array antenna which comprises a plurality of antenna elements and a plurality of phase shifters connected to each of the antenna elements.

A conventional phased array antenna system is shown in FIG. 1. The phased array antenna system includes a number of modules 1, a number of antenna elements 2, a pick-up antenna 3, a power distribution/-synthesis circuit 4, a control circuit 5, a transmitter 6, a receiver 7, and a computer 8 for controlling the modules 1 and for processing the signals received by the receiver 7.

An example of the module 1 is shown in FIG. 2. The module includes a high-power amplifier 1*a*, a low-noise amplifier 1*b*, a phase shifter 1*c*, and a pair of transmitter/receiver switches 1*d*.

The transmission operation is described with reference to FIGS. 1 and 2. A signal power generated by the transmitter 6 is distributed at desired distribution ratios by the power distribution/synthesis circuit 4 to the respective modules 1. The phase of each distributed signal power is shifted bY the phase shifter 1*c* by a desired amount controlled bY the computer 8. Then, the shifted signal power is amplified by the highpower amplifier 1*a* and transmitted from the antenna element 2.

In the case of reception, the transmitter is substituted by the receiver, and the received signal is amplified by the low-noise amplifier 1*b*.

With the above phased array antenna it is impossible to achieve the desired antenna characteristics because of the uneven characteristics of each component. Thus, the composite power of the phased array antenna is measured while changing the phase of a phase shifter for each element by the method disclosed in Japanese Patent Application Kokai No. 57-93267 (the '267 patent) to determine the ratio of the maximum power level to the minimum power level, $r^2$, and the phase value, $\Delta_o$, for the maximum power level in order to find the optimum phase and amplitude for each element.

In the measurement by the conventional antenna system, it is necessary to space the pick-up antenna at a certain distance from the rest of the device. Consequently, it is impossible to make measurements with a phased antenna installed in a moving object or where there is no space for placing the pick-up antenna at a sufficient distance to meet the far field condition for antenna measurement.

SUMMARY OF THE INVENTION

Accordingly, it is an object of the invention to provide a phased array antenna for which it is possible to measure the amplitude and phase of each element even if it is installed in a moving object or there is little space for placing the pick-up antenna.

According to an aspect of the invention, the pick-up antenna is incorporated in the phased array antenna to make use of the measurement technique by which changes in the composite power are measured while changing the phase of each phase shifter to determine the amplitude and phase of each element.

According to another aspect of the invention, a plurality of pick-up antennas are incorporated in the phased array antenna, and signals are synthesized by the distribution/synthesis circuit, thereby making measurements possible.

Since the amplitude and phase of each element are measured without spacing the pick-up antenna apart from the rest of the device, it is possible to make measurements anywhere.

DESCRIPTION OF THE PREFERRED EMBODIMENT

Figure 1:
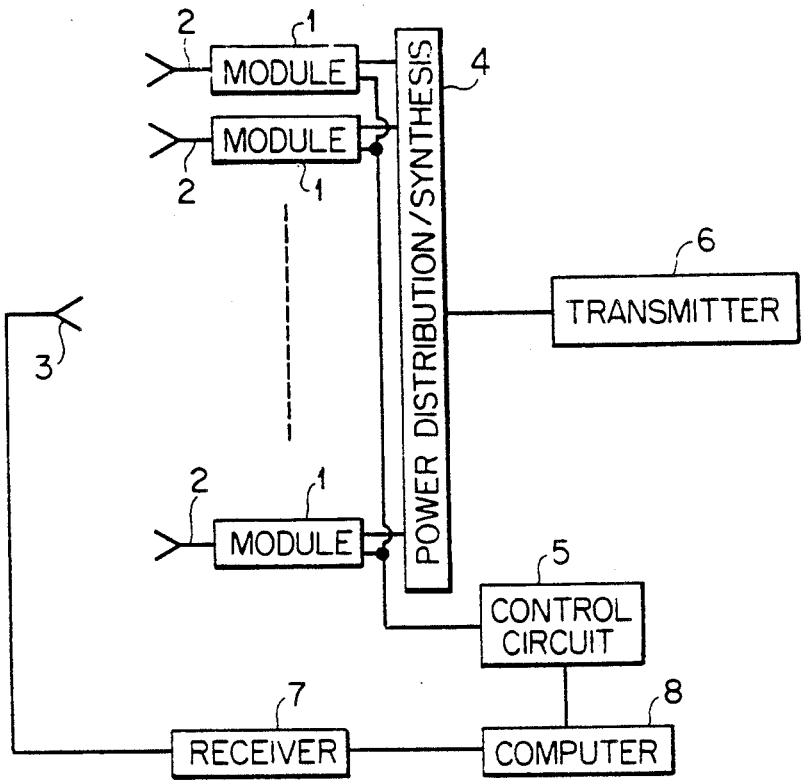
FIG. 1 PRIOR ART
FIG. 1 is a block diagram of a conventional antenna measurement system.
Figure 3:
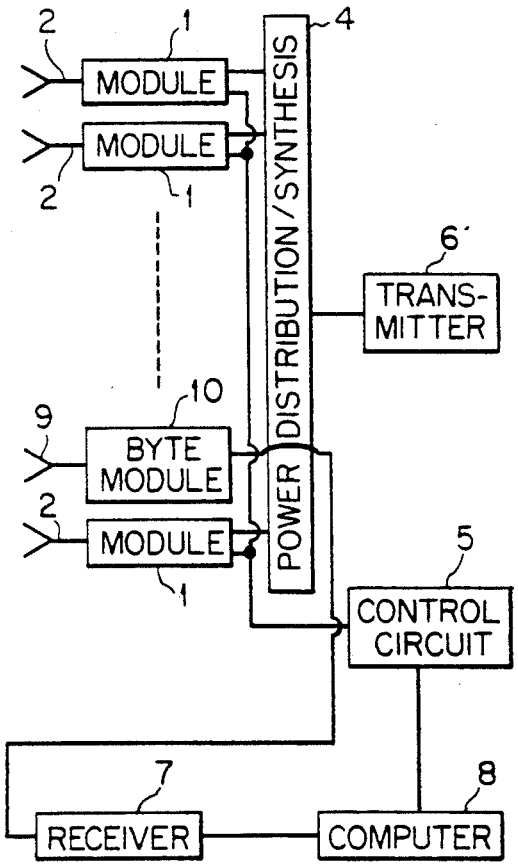
FIG. 3 is a block diagram of a phased array antenna system according to an embodiment of the invention.

In FIG. 3, like reference numerals in common with those in FIG. 1 denote elements like or corresponding to those of FIG. 1. The phased array antenna system includes a pick-up antenna 9 which is incorporated therein, and as shown, is substantially identical in structure as the antenna elements 2. However, the pick-up antenna 9 is not necessarily identical to the antenna elements 2. Byte module 10 appears to be identical to the module 1, but instead transfers RF signals.

Figure 2:
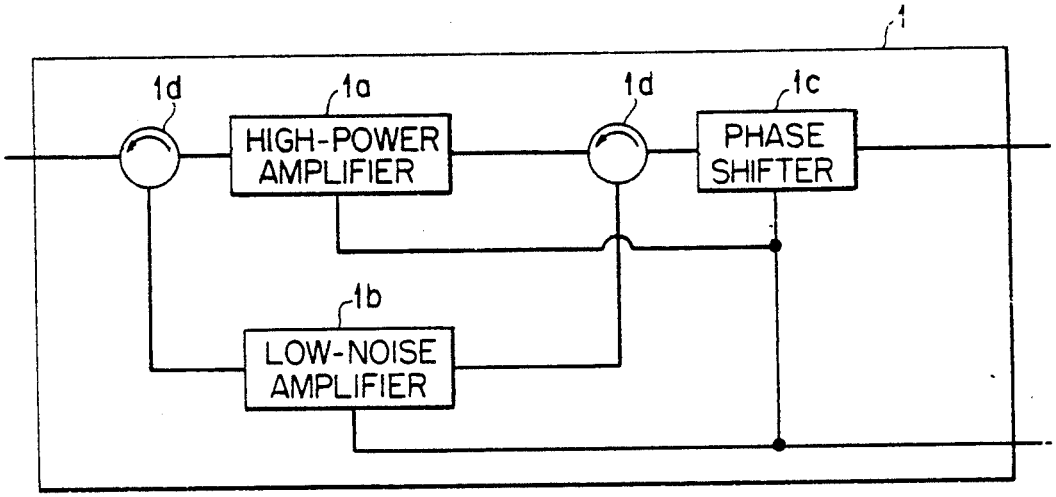
FIG. 2 PRIOR ART
FIG. 2 is a block diagram of a module useful for the antenna system of FIG. 1.

Measurement in the transmission operation is as follows. The signal power generated by the transmitter 6 is distributed by the power distribution/synthesis circuit 4 to the respective modules 1. As shown in FIG. 2, the phase of each distributed signal power is controlled by the computer 8 via the phase shifter 1*c*, and the phased signal power is amplified by the high-power amplifier 1*b* and radiated from the antenna element 2. Part of the radiation is received by the pick-up antenna 9 and transmitted to the receiver 7 via the byte module 10. At this point, the composite power of the phased array antenna is received by the pick-up antenna 9 while changing the phase of a phase shifter for each element by the method of the '267 patent. The maximum-to-minimum ratio of the power level, $r^2$, and the phase value for the maximum power level, $\Delta_o$, are determined to give the optimum phase and amplitude for each element. Let the amplitudes and the phases thus determined be $$a_{11}, a_{12} \ldots a_{1n} \quad (1)$$

$$P_{11}, P_{12} \ldots P_{1n} \quad (2)$$

where n is the number of elements. That is, $a_{11}$–$a_{1n}$ and $P_{11}$–$P_{1n}$ are exciting amplitudes and exciting phases of respective antenna elements 2 determined by the method of the '267 patent for a receiving system in which radiation from each antenna element 2 is received by the pick-up antenna 9, as shown in FIG. 1. Also, let the amplitudes and the phases determined by the conventional method or the spaced pick-up antenna be $$a_{01}, a_{02} \ldots a_{0n} \tag{3}$$

$$P_{01}, P_{02} \ldots P_{0n} \tag{4}$$

Here, $a_{01}$–$a_{0n}$ and $P_{01}$–$P_{0n}$ are the exciting amplitudes and the exciting phases of respective antenna elements 2 determined by the method of the '267 patent for a receiving system in which radiation from each antenna element 2 is received by the pick-up antenna 3, as shown in FIG. 1. From (1), (2), (3) and (4), the amplitude differences $AD_1$, $AD_2$,..., $AD_n$ are, $$\left.\begin{aligned} AD_1 &= a_{01} - a_{11} \\ AD_2 &= a_{02} - a_{12} \\ &\vdots \\ AD_n &= a_{0n} - a_{1n} \end{aligned}\right\} \tag{5}$$

and the phase differences $PD_1$, $PD_2$,...$PD_n$ are $$\left.\begin{aligned} PD_1 &= P_{01} - P_{11} \\ PD_2 &= P_{02} - P_{12} \\ &\vdots \\ PD_n &= P_{0n} - P_{1n} \end{aligned}\right\} \tag{6}$$

Then, under different conditions of phased array antenna, for example, when a module 1 is replaced if the highpower amplifier, low noise amplifier, or phase shifter becomes out of order, similar measurement is made with the pick-up antenna incorporated in the phased array antenna. If the amplitudes and phase determined are $$a_{21}, a_{22} \ldots a_{2n} \tag{7}$$

$$P_{21}, P_{22} \ldots P_{2n} \tag{8}$$

From (5) and (7), and (6) and (8), $$\left.\begin{aligned} A_1 &= AD_1 + a_{21} \\ A_2 &= AD_2 + a_{22} \\ &\vdots \\ A_n &= AD_n + a_{2n} \end{aligned}\right\} \tag{9}$$

-continued $$\left.\begin{aligned} P_1 &= PD_1 + P_{21} \\ P_2 &= PD_2 + P_{22} \\ &\vdots \\ P_n &= PD_n + P_{2n} \end{aligned}\right\} \tag{10}$$

$A_1$, $A_2$..., An and $P_1$, $P_2$,..., Pn are the amplitudes and phases of the respective elements under such conditions.

Alternatively, correction may be made with respect to only the replaced modules, as follows.

$$A_c = a_{0c} - (a_{1c} - a_{2c}) \tag{11}$$

$$P_c = P_{0c} - (P_{1c} - P_{2c}) \tag{12}$$

wherein c is the replaced element. The amount of data in this case is twice that of the above because all the data represented by (1), (2), (3), and (4) is involved.

In this way, in other words, by storing the data represented by (1), (2), (3), and (4) in the computer when the phased array antenna is delivered or installed in an airplane or ship, it is possible to determine the amplitude and phase of each element by simple measurement with the pick-up antenna incorporated in the phased array antenna as needed.

Figure 4:
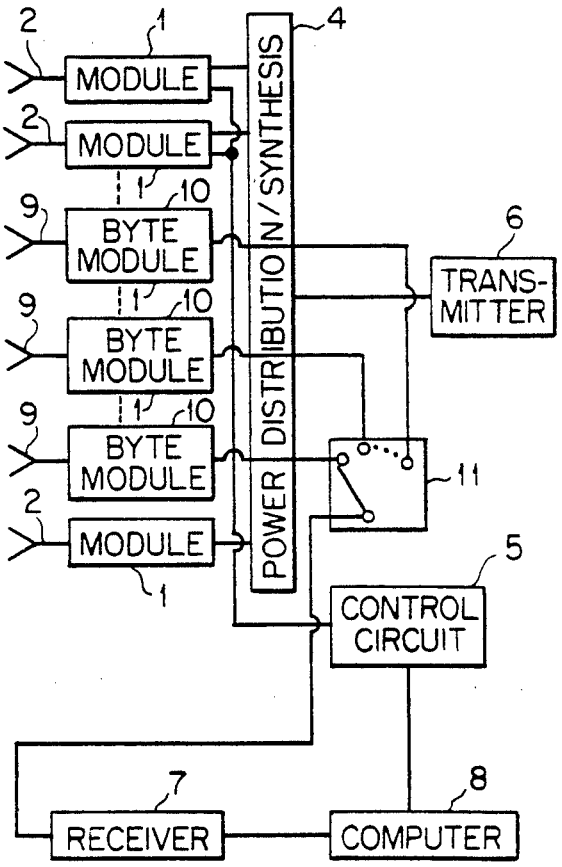
FIG. 4 is a block diagram of a phased array antenna system according to another embodiment of the invention.

In FIG. 4, like reference numerals denote like or corresponding parts of FIG. 3. This phased array antenna system includes a switch 11 and a plurality of pick-up antennas 9 incorporated therein. The measurement method is the same as that of the above embodiment except that it is repeated for the number of times equal to the number of pick-up antennas. Among them, the amplitude and phase of the highest mutual coupling quantity or measured by the pick-up antenna most closely disposed are employed. The other correction procedure is the same as the above.

Alternatively, the measures of the respective pick-up antennas may be averaged as follows. Corresponding to the amplitudes and phases measured by the respective pick-up antennas in the above embodiment, let Pick up Antenna 1:

$$x_{11}, x_{12}, \ldots x_{1n};\ y_{11}, y_{12}, \ldots y_{1n}$$

Pick-up Antenna 2:

$$x_{21}, x_{22}, \ldots x_{2n};\ y_{21}, y_{22}, \ldots y_{2n}$$

$$\vdots$$

Pick-up Antenna l:

$$x_{l1}, x_{l2}, \ldots x_{ln},\ y_{l2}, \ldots y_{ln}$$

Averaging these measures gives $$a_{1m} = \frac{1}{n} \sum_{k=1}^{l} x_{km};\ P_{1m} = \frac{1}{n} \sum_{k=1}^{l} y_{km}\ (m = 1, 2 \ldots n)$$

Every time measurement is made with the incorporated pick-up antenna, this averaging operation is performed.

The subsequent procedure is the same as that of the first embodiment.

While the transmission operations have been described in the above embodiments, the receiving operations are made in the same way. The structures of the phased array antenna and pick-up antenna may be any of the conventional ones.

Figure 5:
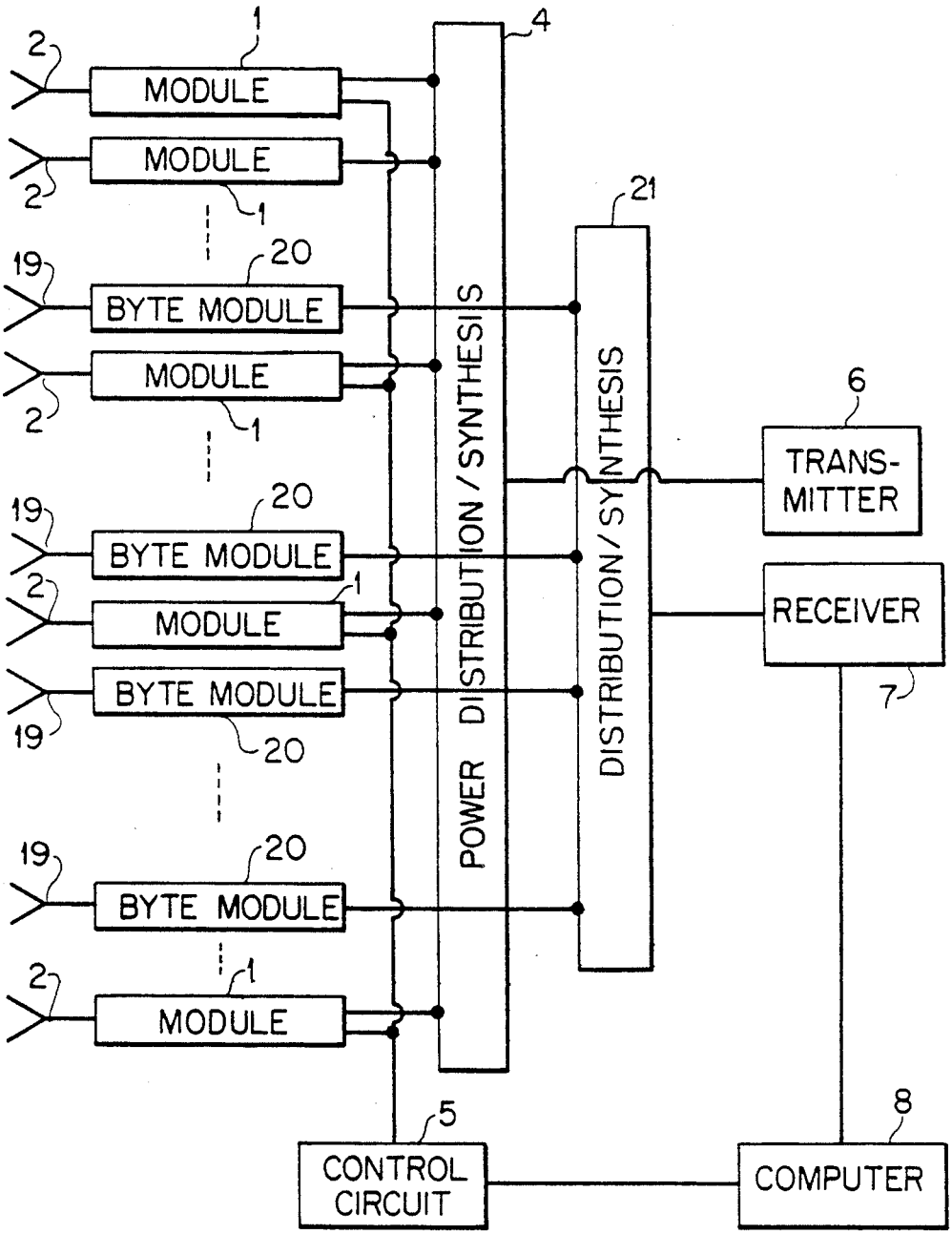
FIG. 5 is a block diagram of a phased array antenna system according to still another embodiment of the invention.

In FIG. 5, like reference numerals denote like or corresponding parts of FIG. 1. This phased array antenna system includes a plurality of pick-up antennas 19 incorporated therein, a plurality of byte modules 20 having an appearance identical with that of the module 1 but transferring RF sign also, and a distribution/synthesis circuit 21.

First, the transmission operation is described. The signal power generated by the transmitter 6 is distributed by the power distribution/synthesis circuit 4 to the respective modules 1. The computer 8 controls the phases of each signal power via the phase shifter 1*c* in FIG. 2. The signal power is amplified by the high-power amplifier 1*a* and radiated from the antenna element 2. Part of the radiation is picked up by the pick-up antennas 19 and synthesized by the distribution/synthesis circuit 21 via the byte modules 20. The synthesized signal is transmitted to the receiver 7. At this point, the composite power of the phased array antenna is received via the pick-up antennas 19 by changing the phase of a phase shifter for each element by the method of the '267 patent. The maximum-to-minimum ratio of the power level, $r^2$, and the phase value for the maximum power level, $\Delta_o$, are found to determine the optimum phase and amplitude for each element. Subsequently, Esq. (1)-(6) are established in the same way as in the first embodiment.

Under different conditions, for example, when some of the modules 1 are replaced, similar measurement is made with the pick-up antennas incorporated in the phased array antenna. Similar to the first embodiment, let the amplitudes and phases measured be (7) and (8) to find the equations (9) and (10). The thus determined $A_1$, $A_2$, ..., An and $P_1$, $P_2$,..., $P_n$ are the amplitudes and phases of the respective elements under such conditions.

Alternatively, correction is made for only the replaced module in the same manner as in the first embodiment $$Ac = a_{0c} - (a1c - a2c) \quad (11)$$

$$Pc - P_{0c} - (P1c - P2c) \quad (12)$$

wherein c is the element replaced. In this case, the amount of data is twice that of the above because all the data represented by (1), (2), (3), and (4) is involved. In this way, by measurements made with only the pick-up antennas in the phased array antenna, it is possible to determine the amplitude and phase of each element.

Figure 6:
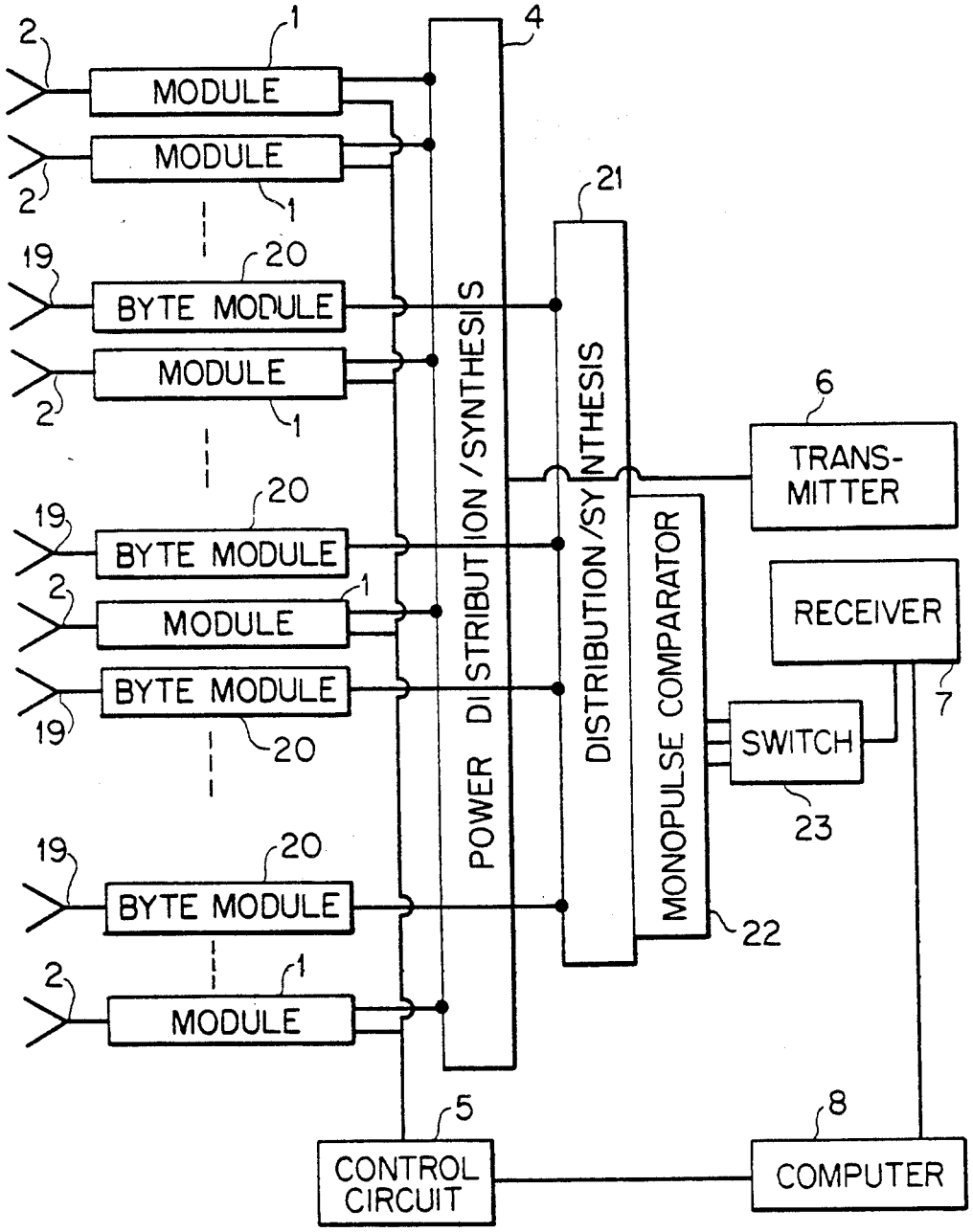
FIG. 6 is a block diagram of a phased array antenna system according to yet another embodiment of the invention.

In FIG. 6, like reference numerals denote like or corresponding parts of FIG. 5. This phased array antenna system further includes a monopulse comparator 22 and a switch 23. The monopulse comparator 22 detects the sum and differential signals of four input signals A, B, C, and D received by the four pick-up antennas 19. That is, it outputs the following signals:

$$Sum = A + B + C + D$$

$$Difference\ 1 = (A + B) - (C + D)$$

$$Difference\ 2 (A + D) - (B + C).$$

The measurement method is the same as above except that it is repeated for the number of times equal to the number of sum and differential signal terminals. Let the amplitudes and phases measured at the respective terminals be Sum signal terminal:

$$x_{11}, x_{12} \cdots x_{1n};\ y_{11}, y_{12} \cdots y_{1n}$$

Differential signal terminal (1):

$$x_{21}, x_{22} \cdots x_{2n};\ y_{21}, y_{22} \cdots y_{2n}$$

Differential signal terminal (2):

$$x_{31}, x_{32} \cdots x_{3n};\ y_{31}, y_{32} \cdots y_{3n}$$

Averaging these measures gives $$a_{1m} = \frac{1}{n} \sum_{k=1}^{3} x_{km};\ P_{1m} = \frac{1}{n} \sum_{k=1}^{3} y_{km}$$

The subsequent correction procedure is the same as

Figure 7:
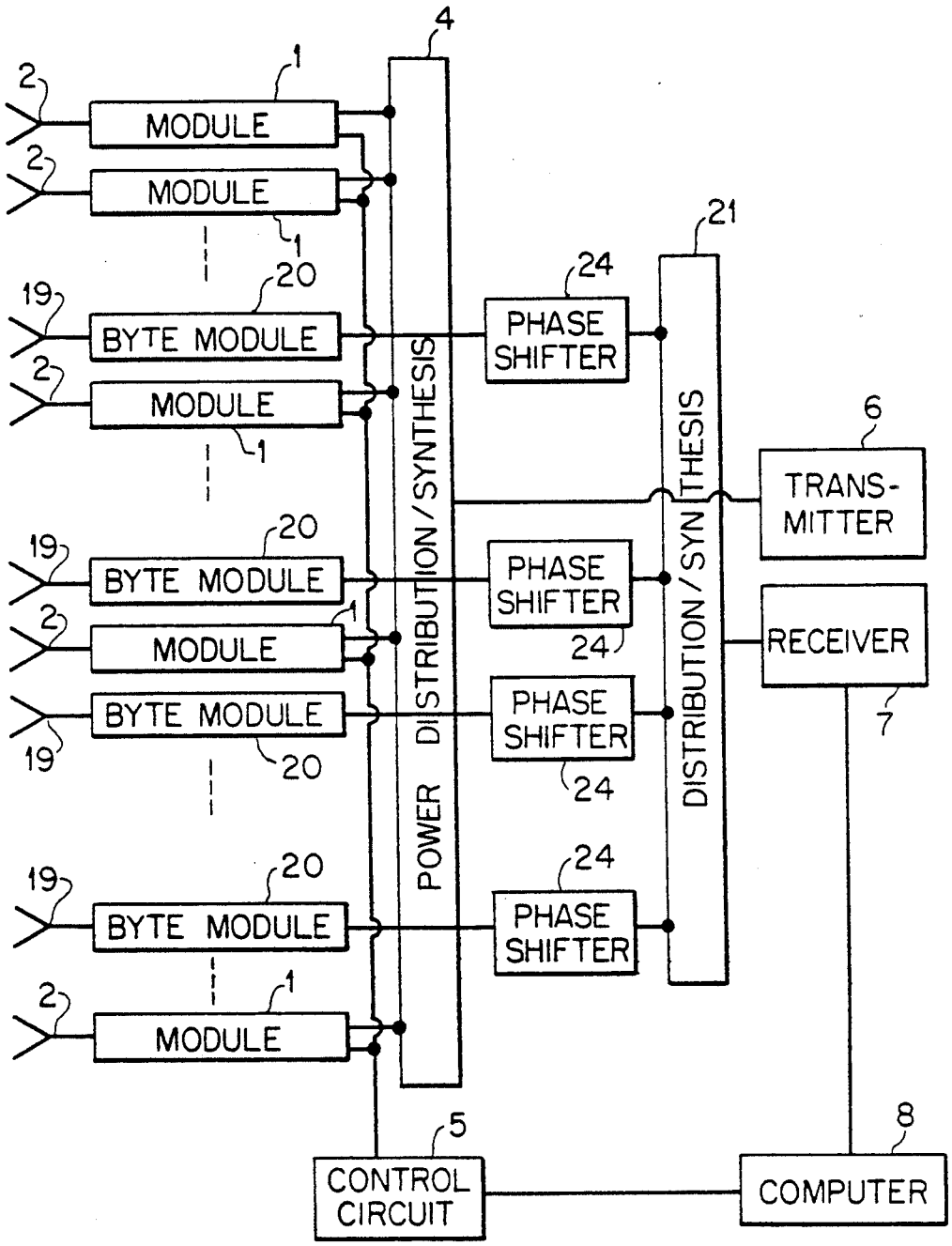
FIG. 7 is a block diagram of a phased array antenna system according to another embodiment of the invention.

In FIG. 7, this phased array antenna includes a plurality of phase shifters 24 for changing the electrical length. Alternatively, the electrical length may be changed mechanically. That is, by changing the phase of each signal in the phase shifter and composing them in the distribution/composition circuit, it is possible to provide the same function as that of the monopulse comparator as shown in FIG. 6. Let the amplitudes and phases measured by the above method by changing the electrical length be Electrical Length Combination 1: $x_{11}x_{12} \ldots x_{n};$ $y_{11}y_{12} \ldots y_{1n}$ Electrical Length Combination 2: $x_{21}x_{22} \ldots x_{2n};$ $y_{21}y_{22} \ldots y_{2n}$

.
.
.

Electrical Length Combination $l$: $x_{l1}x_{l2} \ldots x_{ln}$ $y_{l1}y_{l2} \ldots y_{ln}$ Averaging these measures gives $$a_{1m} = \frac{1}{n} \sum_{k=1}^{l} x_{km};\ P_{1m} = \frac{1}{n} \sum_{k=1}^{l} y_{km}\ (m - 1, 2 \ldots n)$$

The subsequent correction procedure is the same as above.

Figure 8:
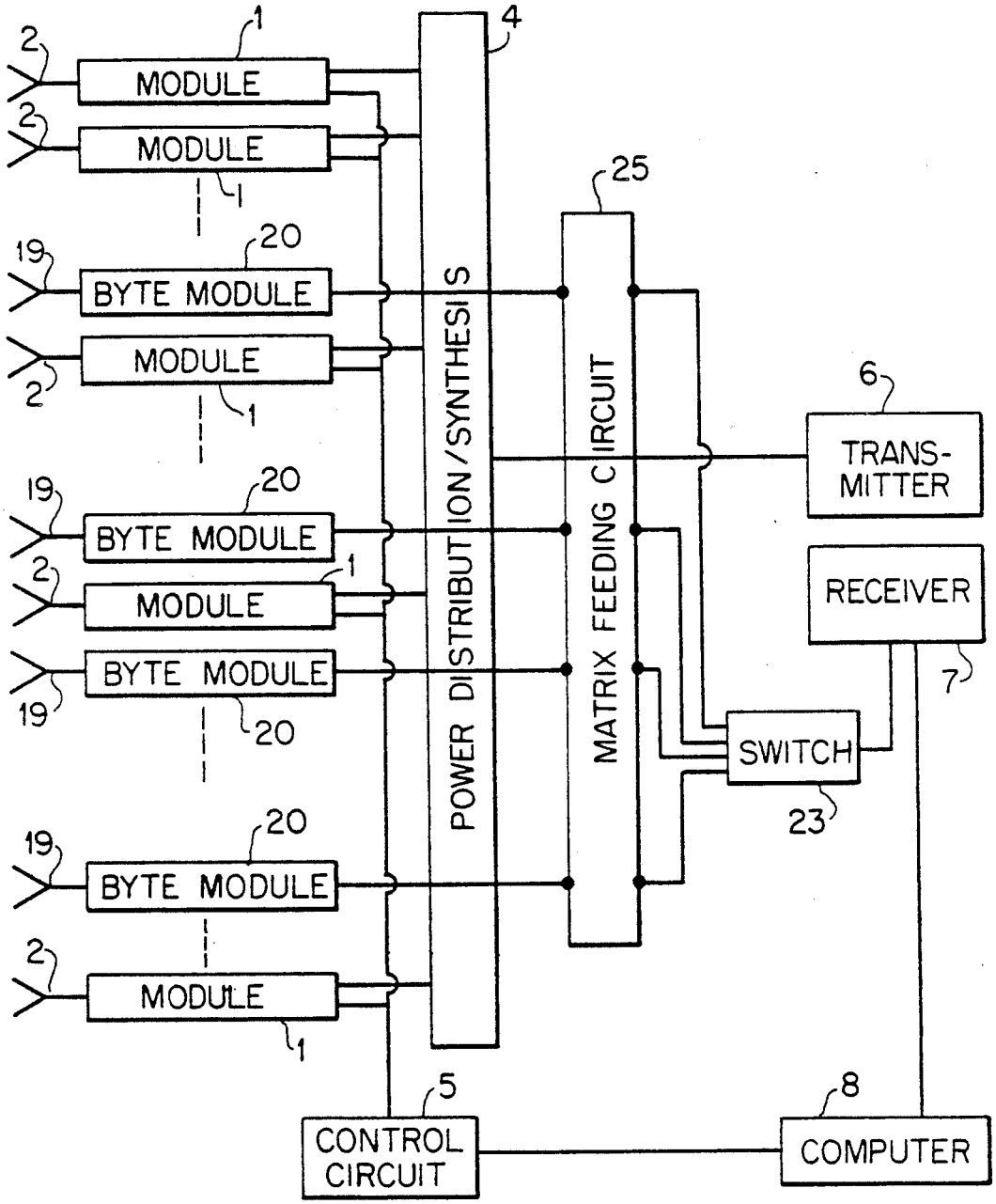
FIG. 8 is a block diagram of a phased array antenna system according to still another embodiment of the invention.

In FIG. 8, this phased array antenna includes a matrix feeding circuit 25. An example of the feeding circuit 25 is a Butler matrix circuit. Instead of changing the electrical length as in FIG. 7, this circuit is able to provide the composite output of signals of different electrical lengths from a plurality of pick-up antennas. The signals are switched for measurement. Let the amplitudes and phases measured at the respective terminals of the matrix feeding circuit be Terminal 1: $x_{11}x_{12} \ldots x_{1n};\ y_{12} \ldots y_{1n}$
Terminal 2: $x_{21}x_{22} \ldots x_{2n};\ y_{22} \ldots y_{2n}$

.
.
.

-continued

Terminal $l$: $x_{l1}x_{l2} \ldots x_{ln}$; $y_{l1}y_{l2} \ldots y_{ln}$

Averaging these measures gives $$a_{1m} = \frac{1}{n} \sum_{k=1}^{l} x_{km};\ P_{1m} = \frac{1}{n} \sum_{k=1}^{l} y_{km}\ (m + 1, 2 \ldots n)$$

The subsequent correction procedure is the same as above.

Although the transmission operations have been described, the reception operations are made in the same way. The structures of the phased array antennas, the pick-up antennas, the distribution/synthesis circuit, and the matrix feeding circuit may be any of the conventional configurations.

As has been described above, with the pick-up antennas incorporated in the phased array antenna, it is possible to measure the amplitude and phase of each element anywhere with high accuracy. In addition, it is possible to maintain the phased array antenna at optimal conditions.

We claim:

1. A phased array antenna comprising a plurality of first antenna elements and a plurality of phase shifters respectively connected to said first antenna elements, an amplitude and a phase of each of said first antenna elements being determined by a method of using a pick-up antenna to measure a composite power of said phased array antenna while changing phases of said phase shifters for determining a ratio of a maximum power to a minimum power and a phase value for said maximum power, from which said amplitude and phases are computed, wherein the improvement comprises:

a second antenna element incorporated in said phased array antenna and operating as a pick-up antenna, to measure with mutual coupling an amplitude and a phase of each of said first antenna elements by said method and to determine differences in amplitude and phase by comparing said amplitudes and phases measured by said second antenna element with amplitudes and phases measured according to said method by a pick-up antenna opposed at a distance from said phased array antenna so that amplitudes and phases subsequently measured with said second antenna element are corrected with said differences in amplitude and phase to determine an amplitude and a phase for each of said first antenna elements.

2. A phased array antenna comprising a plurality of first antenna elements and a plurality of phase shifters respectively connected to said first antenna elements, an amplitude and a phase of each of said first antenna elements being determined by a method of using a pick-up antenna to measure a composite power to said phased array antenna while changing phases of said phase shifters for determining a ratio of a maximum power to a minimum power and a phase value for said maximum power, from which said amplitudes and phases are computed, wherein the improvement comprises:

a plurality of second antenna elements incorporated in said phased array antenna and operating as pick-up antennas, to measure with mutual coupling an amplitude and a phase of each of said first antenna elements by said method for a number of times equal to the number of said second antenna elements and to determine differences in amplitude and phase by comparing said amplitudes and phases measured by said second antenna elements as measured with the said pick-up antenna most closely disposed thereto with amplitudes and phases measured according to said method by a pick-up antenna opposed at a distance from said phased array antenna so that amplitudes and phases subsequently measured with said second antenna elements are corrected with said differences in amplitude and phase to determine an amplitude and a phase for each of said first antenna elements.

3. A phased array antenna comprising a plurality of first antenna elements and a plurality of phase shifters respectively connected to said first antenna elements, an amplitude and a phase of each of said first .antenna elements being determined by a method of using a pick-up antenna to measure a composite power of said phased array antenna while changing phases of said phase shifters for determining a ratio of a maximum power to a minimum power and a phase value for said maximum power, from which said amplitudes and phases are computed, wherein the improvement comprises:

a plurality of second antenna elements incorporated in said phased array antenna and operating as pick-up antennas, to measure with mutual coupling an amplitude and a phase of each of said first antenna elements by slide method for a number of times equal to the number of said second antenna elements and to average said amplitudes and phases in order to determine differences in amplitude and phase by comparing said amplitudes and phases measured by said second antenna elements with amplitudes and phases measured according to said method by a pick-up antenna opposed at a distance from said phased array antenna so that amplitudes and phases subsequently measured with said second antenna elements are corrected with said differences in amplitude and phase to determine an amplitude and a phase of each of said first antenna elements.

4. A phased array antenna comprising a plurality of first antenna elements and a plurality of phase shifters respectively connected to each of said first antenna elements, an amplitude and a phase of each of said first antenna elements being determined by a method of using a pick-up antenna to measure a composite power of said phased array antenna while changing phases of said phase shifters for determining a ratio of a maximum power to a minimum power and a phase value for said maximum power, from which said amplitude and phase are computed, wherein the improvement comprises:

a plurality second antenna elements incorporated in said phased array antenna and operating as pick-up antennas; and a distribution/synthesis circuit for synthesizing output signals from said second antenna elements to perform measurement with mutual coupling of an amplitude and a phase of each of said first antenna elements by slide method and to determine differences in amplitude and phase by comparing said amplitudes and phases measured by said second antenna elements with amplitudes and phases measured according to said method by a pick-up antenna opposed at a distance from said phased array antenna so that amplitudes and phases subsequently measured with said second antenna elements are corrected with said differences in amplitude and phase to determine an amplitude and a phase for each of said first antenna elements.

5. A phased array antenna comprising a plurality of first antenna elements and a plurality of phase shifters respectively connected to said first antenna elements, an amplitude and a phase of each of said first antenna elements being determined by a method of using a pick-up antenna to measure a composite power of said phased array antenna while changing phases of said phase shifters for determining a ratio of a maximum power to a minimum power and a phase value for said maximum power, from which said amplitude and phase are computed, wherein the improvement comprises:

a plurality of second antenna elements incorporated in said phased array antenna and operating as pick-up antennas;

a distribution/synthesis circuit connected to said second antenna elements;

a monopulse comparator connected to said distribution/synthesis circuit;

a receiver; and a switch connecting said receiver to said monocomparator to measure with mutual coupling amplitudes and phases of each of said first antenna elements by said method corresponding to respective terminals of said monocomparator to determine an amplitude and a phase of each of said first antenna elements by averaging said amplitudes and phases, and to determine differences in amplitude and phase by comparing said amplitudes and phases measured by said second antenna elements with amplitudes and phases measured according to said method by a pick-up antenna opposed at a distance from said phased array antenna so that amplitudes and phases subsequently measured with said second antenna elements are corrected with said differences in amplitude and phase to determine an amplitude and a phase for each of said first antenna elements.

6. A phased array antenna comprising a plurality of first antenna elements and a plurality of phase shifters respectively connected to said first antenna elements, an amplitude and a phase of each of said first antenna elements being determined by a method of using a pick-up antenna to measure a composite power of said phased array antenna while changing phases of said phase shifters for determining a ratio of a maximum power to a minimum power and a phase value for said maximum power, from which said amplitude and phase are computed, wherein the improvement comprises:

a plurality of second antenna elements incorporated in said phased array antenna and operating as pick-up antennas;

a plurality of second phase shifters respectively connected to said second antenna elements; and a distribution/synthesis circuit connected to said second phase shifters to measure with mutual coupling amplitudes and phases of said first antenna elements by said method while changing electrical lengths of-said second phase shifters to determine an amplitude and a phase of each of said first antenna elements by averaging said measured amplitudes and phases and to determine differences in amplitude and phase by comparing said amplitudes and phases measured by said second antenna elements with amplitudes and phases measured according to said method by a pick-up antenna opposed at a distance from said phased array antenna so that amplitudes and a phases subsequently measured with said second antenna elements are corrected with said differences in amplitude and phase to determine an amplitude and a phase of each of said first antenna elements.

7. A phased array antenna comprising a plurality of first antenna elements and a plurality of phase shifters respectively connected to said first antenna elements, an amplitude and a phase of each of said first antenna elements being determined by a method of using a pick-up antenna to measure a composite power of said phased array antenna while changing phases of said phase shifters for determining a ratio of a maximum power to a minimum power and a phase value for said maximum power, from which said amplitude and phase are computed, wherein the improvement comprises:

a plurality of second antenna elements incorporated in said phased array antenna and operating as a pick-up antenna;

a matrix feeding circuit connected to said second antenna elements;

a switch connected to said matrix feeding circuit; and a receiver connected to said switch to measure with mutual coupling amplitudes and phases of said first antenna elements by said method while switching output terminals of said matrix feeding circuit to determine an amplitude and a phase of each of said first antenna elements by averaging said measured amplitudes and phases and by determining differences in amplitude and phase by comparing said amplitudes and phases measured by said second antenna elements with amplitudes and phases measured according to said method by a pick-up antenna opposed at a distance from said phased array antenna so that amplitudes and phases subsequently measured with said second antenna elements are corrected with said differences in amplitude and phase to determine an amplitude and a phase for each of said first antenna elements.

8. An apparatus for measuring an amplitude and a phase of each antenna element of a phased array antenna comprising a plurality of first antenna elements and a plurality of phase shifters respectively connected to said first antenna elements, said apparatus comprising:

means for opposing a first pick-up antenna at a distance from said phased array antenna to measure a composite power of said phased array antenna while changing phases of said phase shifters for determining a ratio of a maximum power to a minimum power and a phase value for said maximum power, from which a first amplitude and a first phase for each of said first antenna elements are computed;

means for disposing at least one second antenna element as a second pick-up antenna incorporated in said phased array antenna to measure with mutual coupling a composite power of said phased array antenna while changing phases of said phase shifters for determining a ratio of a maximum power to a minimum power and a phase value for said maximum power, from which a second amplitude and a second phase for each of said first antenna elements are computed;

means for determining differences in amplitude and phase between said first amplitude and phase and said second amplitude and phase for each respective antenna element; and memory means for storing data indicating said differences so that an amplitude and a phase subsequently measured with said at least one second antenna element are corrected with said differences in amplitude and phase to determine an amplitude and a phase of each of said first antenna elements.

9. A method of measuring an amplitude and a phase of each antenna element of a phased array antenna comprising a plurality of first antenna elements and a plurality of phase shifters respectively connected to said first antenna elements, which comprises the steps of:

opposing a first pick-up antenna at a distance from said phase array antenna to measure a composite power of said phased array antenna while changing phases of said phase shifters for determining a ratio of a maximum power to a minimum power and a phase value for said maximum power, from which a first amplitude and a first phase for each of said first antenna elements are computed:

disposing at least one second antenna element as a second pick-up antenna incorporated in said phased array antenna to measure with mutual coupling a composite power of said phased array antenna while changing phases of said phase shifters for determining a ratio of a maximum power to a minimum power and a phase value for said maximum power, from which a second amplitude and a second phase for each of said first antenna elements are computed;

determining differences in amplitude and phase between said first amplitude and phase and said second amplitude and phase for each said antenna element; and storing data indicating said differences so that an amplitude and a phase subsequently measured with said at least one second antenna element are corrected with said differences in amplitude and phase to determine an amplitude and a phase of each of said first antenna elements.

10. A method of measuring an amplitude and phase of each antenna element of phased array antenna of the type comprising, a plurality of first antenna elements and a plurality of phase shifters respectively connected to said first antenna elements, determining an amplitude and phase of each of said first antenna elements by using a pick-up antenna to measure a composite power of said phased array antenna while changing phases of said phase shifters for determining a ratio of a maximum power to a minimum power and phase value for said maximum power, from which said amplitude and phase are computed;

providing a second antenna element in said phased array antenna; and operating said second antenna element as a pick-up antenna to measure with mutual coupling an amplitude and a phase of each of said first antenna elements by measuring a composite power of said phased array antenna while changing phases of said phase shifters for determining a ratio of maximum power to a minimum power and a phase value for said maximum power;

determining differences in amplitude and phase by comparing said amplitudes and phases measured by said second antenna element with amplitudes and phases measured by said pick-up antenna opposed at a distance from said phased array antenna so that amplitudes and phases subsequently measured with said second antenna element are corrected with said differences in amplitude and phase to determine an amplitude and a phase for each of said first antenna elements.

11. A method of measuring an amplitude and phase of each antenna element of a phased array antenna of the type comprising, a plurality of first antenna elements and a plurality of phase shifters respectively connected to said first antenna elements, determining an amplitude and a phase of each of said first antenna elements by using a pick-up antenna to measure a composite power to said phased array antenna while changing phases of said phase shifters for determining a ratio of a maximum power, from which said amplitudes and phases are computed;

providing a plurality of second antenna elements in said phased array antenna;

operating said second antenna elements as pick-up antennas to measure with mutual coupling an amplitude and a phase of each of said first antenna elements by measuring a composite power of said phased array antenna while changing phases of said phase shifters for determining a ratio of maximum power to a minimum power and a phase value for said maximum power;

performing said last mentioned measuring step a number of times equal to the number of said second antenna elements; and determining differences in amplitude and phase by comparing said amplitudes and phases measured by said second antenna elements most closely disposed thereto with amplitudes and phases measured by said pick-up antenna opposed at a distance from said phased array antenna so that amplitudes and phases subsequently measured with said second antenna elements are corrected with said differences in amplitude and phase to determine an amplitude and a phase for each of said first antenna elements.

12. A method of measuring an amplitude and phase of each antenna element of a phased array antenna of the type comprising, a plurality of first antenna elements and a plurality of phase shifters respectively connected to said first antenna elements;

determining an amplitude and a phase of each of said first antenna elements by using a pick-up antenna to measure a composite power of said phased array antenna while changing phases of said phased shifters for determining a ratio of a maximum power to a minimum power and phase value for said maximum power, from which said amplitudes and phases are computed;

providing a plurality of second antenna elements in said phased array antenna;

operating said second antenna elements as pick-up antennas to measure with mutual coupling an amplitude and a phase of each of said fist antenna elements by measuring a composite power of said phased array antenna while changing phases of said phase shifters for determining a ratio of maximum power to a minimum power and a phase value for said maximum power;

performing said last mentioned measuring step a number of times equal to the number of said second antenna elements; and averaging said amplitudes and phases in order to determine differences in amplitude and phase by comparing said amplitudes and phases measured by said second antenna elements with amplitudes and phases measure by said pick-up antenna opposed at a distance from said phased array antenna so that amplitudes and phases subsequently measured with said second antenna elements are corrected with said differences in amplitude and phase to determine an amplitude and phase of each of said first antenna elements.

13. A method of measuring an amplitude and phase of each antenna element of phased array antenna of the type comprising, a plurality of first antenna elements and a plurality of phase shifters respectively connected to each of said first antenna elements;

determining an amplitude and a phase of each of said first antenna elements by using a pick-up antenna to measure a composite power of said phased array antenna while changing phases of said phase shifters for determining a ratio of a maximum power to a minimum power and phase value for said maximum power, from which said amplitude and phase are computed;

providing a plurality of second antenna elements in said phased array antenna, operating said second antenna elements as pick-up antennas.

providing a distribution/synthesis circuit for synthesizing output signals from said second antenna elements to perform measurement with mutual coupling of an amplitude and a phase of each of said first antenna elements by measuring a composite power of said phased array antenna while changing phases of said phase shifters for determining a ratio of maximum power to a minimum power and a phase value for said maximum power; and determining differences in amplitude and phase by comparing said amplitudes and phases measured by said second antenna elements with amplitudes and phases measured by said pick-up antenna opposed at a distance from said phased array antenna so that amplitudes and phases subsequently measured with said second antenna elements are corrected with said differences in amplitude and phase to determine an amplitude and a phase for each of said first antenna elements.

* * * * *